US005567026A

United States Patent [19]

Lacewell

[11] Patent Number: 5,567,026

[45] Date of Patent: Oct. 22, 1996

[54] APPARATUS FOR DISPLAYING PRODUCTS

[75] Inventor: Edward L. Lacewell, Pontotoc, Miss.

[73] Assignee: Master-Bilt, Pontotoc, Miss.

[21] Appl. No.: 333,422

[22] Filed: Nov. 2, 1994

[51] Int. Cl.[6] ..... A47F 3/10

[52] U.S. Cl. ..... 312/135; 312/116; 312/305; 312/401; 312/408; 62/264; 211/131; 108/94; 108/96

[58] Field of Search ..... 312/116, 135, 312/401, 404, 408, 305; 62/264; 108/94, 96; 211/131, 129, 144

[56] References Cited

U.S. PATENT DOCUMENTS

| | | | |
|---|---|---|---|
| 228,812 | 6/1880 | Greenbaum | 211/131 X |
| 991,541 | 5/1911 | Rapoport | 312/305 |
| 1,497,825 | 6/1924 | Zahl | 312/305 X |
| 1,581,171 | 4/1926 | Bushman . | |
| 1,635,201 | 7/1927 | Bell et al. . | |
| 1,908,928 | 5/1933 | Stein . | |
| 2,115,343 | 4/1938 | Scurlock . | |
| 2,142,008 | 12/1938 | Scott . | |
| 2,308,629 | 1/1943 | Rosenberg | 211/131 |
| 2,327,742 | 8/1943 | Rosenberg | 211/131 |
| 2,359,182 | 6/1940 | Wilsey . | |
| 2,610,473 | 9/1952 | Chovanec | 312/116 X |
| 2,680,668 | 6/1954 | Stanfiel et al. | 312/305 |
| 3,097,746 | 7/1963 | Handler et al. . | |
| 3,405,281 | 10/1968 | Wilson | 62/264 X |
| 3,982,801 | 9/1976 | Heidorn et al. . | |
| 4,454,948 | 6/1984 | Spamer . | |
| 4,582,372 | 4/1986 | Cooper . | |
| 4,624,113 | 11/1986 | Hull et al. | 62/264 X |
| 4,736,856 | 4/1988 | Alneng et al. . | |
| 4,738,495 | 4/1988 | Mitts . | |
| 5,056,332 | 10/1991 | Tajima et al. | 312/116 X |
| 5,184,471 | 2/1993 | Losacco et al. | 62/264 X |
| 5,253,488 | 10/1993 | Kim et al. | 62/264 X |
| 5,255,801 | 10/1993 | Berger . | |
| 5,271,591 | 12/1993 | Pittella . | |
| 5,277,486 | 1/1994 | Bustos | 312/116 X |

*Primary Examiner*—Peter M. Cuomo
*Assistant Examiner*—Rodney B. White
*Attorney, Agent, or Firm*—Needle & Rosenberg, P.C.

[57] ABSTRACT

A rotating shelf display comprises a plurality of upstanding side walls defining an enclosure. The enclosure has a front half and a back half, with at least one of the side walls at the front half of the enclosure being transparent so that objects on the shelf can be seen from outside. Within the enclosure is a circular rotating shelf. The vertical axis of the shelf lies between the front half and the back half of the enclosure. The shelf comprises a disk having an outer edge and a rim upwardly extending about the outer edge. Disposed within only the back half of the enclosure are means for supporting the shelf for rotation about its vertical axis. The supporting means comprises at least three vertical members secured within the back half of the enclosure. Mounting pegs are detachably secured to each vertical member. An axle is affixed to each mounting peg. A roller is rotably attached to each axle. At least three horizontally spaced apart bottom rollers engage the bottom surface of the disk to prevent the shelf in the back half of the enclosure from tipping downward while allowing the shelf to rotate about its axis. A top support roller is disposed in the back half of the enclosure above and between at least two of the bottom support rollers to prevent the portion of the shelf in the back half of the enclosure from tipping upward.

18 Claims, 4 Drawing Sheets

APPARATUS FOR DISPLAYING PRODUCTS

BACKGROUND OF THE INVENTION

1. Field of the Invention

The present invention relates to an enclosure for displaying products and particularly to a refrigerated enclosure for displaying products on rotatable shelves.

2. Description of the Prior Art

As commonly found in self-service convenience stores, enclosures having rotating shelves have long been known in the art of displaying soft drinks and other products. The enclosures are typically refrigerated and have transparent doors through which customers access the product. Existing rotatable shelf enclosures have either an axial post supporting the shelves, which block the view of some of the product being displayed, or they have supports disposed around the shelves attached to the enclosure walls. Supports disposed in the front of the enclosure tend to block the lighting of objects being displayed and, thus, limit the placement of lamps used to illuminate the displayed products.

Bushman (U.S. Pat. No. 1,581,171) shows a display case also having round, rotatable shelves supported by rollers spaced evenly around the shelves. Scurlock (U.S. Pat. No. 2,115,343) shows a refrigerator having round, rotatable shelves supported by rollers spaced evenly around the shelves. Scott (U.S. Pat. No. 2,142,008) also shows a round, rotatable refrigerator shelf supported by rollers spaced evenly around the shelf.

Bustos (U.S. Pat. No. 5,277,486) shows another variation of a display having round, rotatable shelves that are supported by brackets on the sides and back of each shelf, and rollers in front of each shelf. It has the added feature of tilted shelves for gravity-feeding the displayed product. The rollers in the front of the shelves prevent the placement of florescent lamps in front along the entire height of the display.

Mitts (U.S. Pat. No. 4,738,495) shows a half-moon rotary shelf assembly having shelves mounted on a vertical post that is connected to a cabinet frame by securing it to a bottom mounting assembly which is, itself, secured to the floor of the cabinet. It rotates around the straight edge of the shelf and not its central axis.

A cantilevered shelf (a shelf that is supported from a backside) would allow greater freedom in light placement and a better view of the product. Several examples of cantilevered shelves are found in the prior art. Pittella (U.S. Pat. No. 5,271,591) shows a bracket for cantilever mounting of flat shelf plates. The shelves are fixed in a mounting projection but the shelves are not rotatable.

Heidorn et al. (U.S. Pat. No. 3,982,801) shows a power operated vertically adjustable shelf supported by shelf arms in a cantilevered fashion but, again, the shelves are not rotatable.

Thus, there exists a need for a display having rotatable shelves, supported from the back, allowing florescent lamps to be placed along the height of the display in the front of the shelf to provide maximum front lighting of the products being displayed.

SUMMARY OF THE INVENTION

The present invention overcomes the disadvantages of the prior art and comprises a refrigerated display having a rotatable shelf system. The display comprises a housing having a plurality of upstanding side walls defining an enclosure which has a front half and a back half. At least one circular, rotatable shelf is positioned within the enclosure, with the vertical axis of the shelf in alignment with the plane defining the interface between the front half and the back half of the enclosure. Disposed within only the back half of the enclosure means are for supporting the shelf for rotation about the vertical axis of the shelf.

The shelf is essentially a disk having a top surface, a bottom surface and an outer edge with a rim upwardly extending about the outer edge of the disk. The rim has an upper surface, an inner surface and an outer surface.

The supporting means comprises a plurality of rollers upon which the shelf rests. At least three vertical members are disposed within the back half of the enclosure and secured to the housing to provide a mounting surface for the rollers. A plurality of mounting pegs are detachably secured to the vertical members and at least one bottom axle is affixed to each mounting peg. A top axle is also affixed to at least one of the mounting pegs.

The support means has at least three bottom axles being secured to the side walls of the back half of the housing and laterally extending into the enclosure. At least three horizontally spaced apart co-planar bottom support rollers are disposed in the back half of the enclosure. Each bottom support roller has a cylindrical member coaxial, with and rotably mounted, on an axle. The cylindrical member of the bottom support rollers engages the bottom surface of the disk adjacent the outer edge to prevent the portion of the shelf in the back half of the enclosure from tipping downward while allowing the shelf to rotate about its axis. The rear edge of the cylindrical member is adjacent the side wall and terminates in a flanged portion disposed adjacent the outer surface of the rim to prevent the disk from moving laterally outward from the front half of the enclosure.

A top support roller is disposed in the back half of the enclosure above the bottom support rollers and is laterally disposed between at least two of the bottom support rollers. A top axle is secured to a sidewall and laterally extends into the enclosure. The top support roller has a cylindrical member rotably mounted on the top axle and the front edge of the cylindrical member terminates in a flanged portion. The cylindrical member of the top support roller engages the upper surface of the rim to prevent the portion of the shelf in the back half of the enclosure from tipping upward while allowing the shelf to rotate about its axis. The flanged portion of the top support roller is adjacent the inner surface of the rim to prevent the disk from moving laterally inward toward the front half of the enclosure.

A lamp is disposed vertically in the front half of the enclosure and positioned to provide illumination of the shelf unobstructed by the supporting means. The lamp may be a fluorescent lamp. Because the enclosure is refrigerated, the lamp is surrounded by a transparent sheath insulating the lamp from refrigerated air in the enclosure. A heating element is disposed within the sheath to maintain the temperature of air surrounding the lamp at a temperature higher than the refrigerated air in the enclosure.

It is an object of the present invention to provide a display having rotatable shelves supported only about the back half of the enclosure.

It is also an object of the present invention to provide a display where florescent lamps are placed in front of the product being displayed for maximal illumination of the product being displayed.

These and other objects will become apparent from the following description of the preferred embodiments taken in conjunction with the following drawings, although variations and modifications may be effected without departing from the spirit and scope of the novel concepts of the disclosure.

DETAILED DESCRIPTION OF THE PREFERRED EMBODIMENTS

Figure 1:
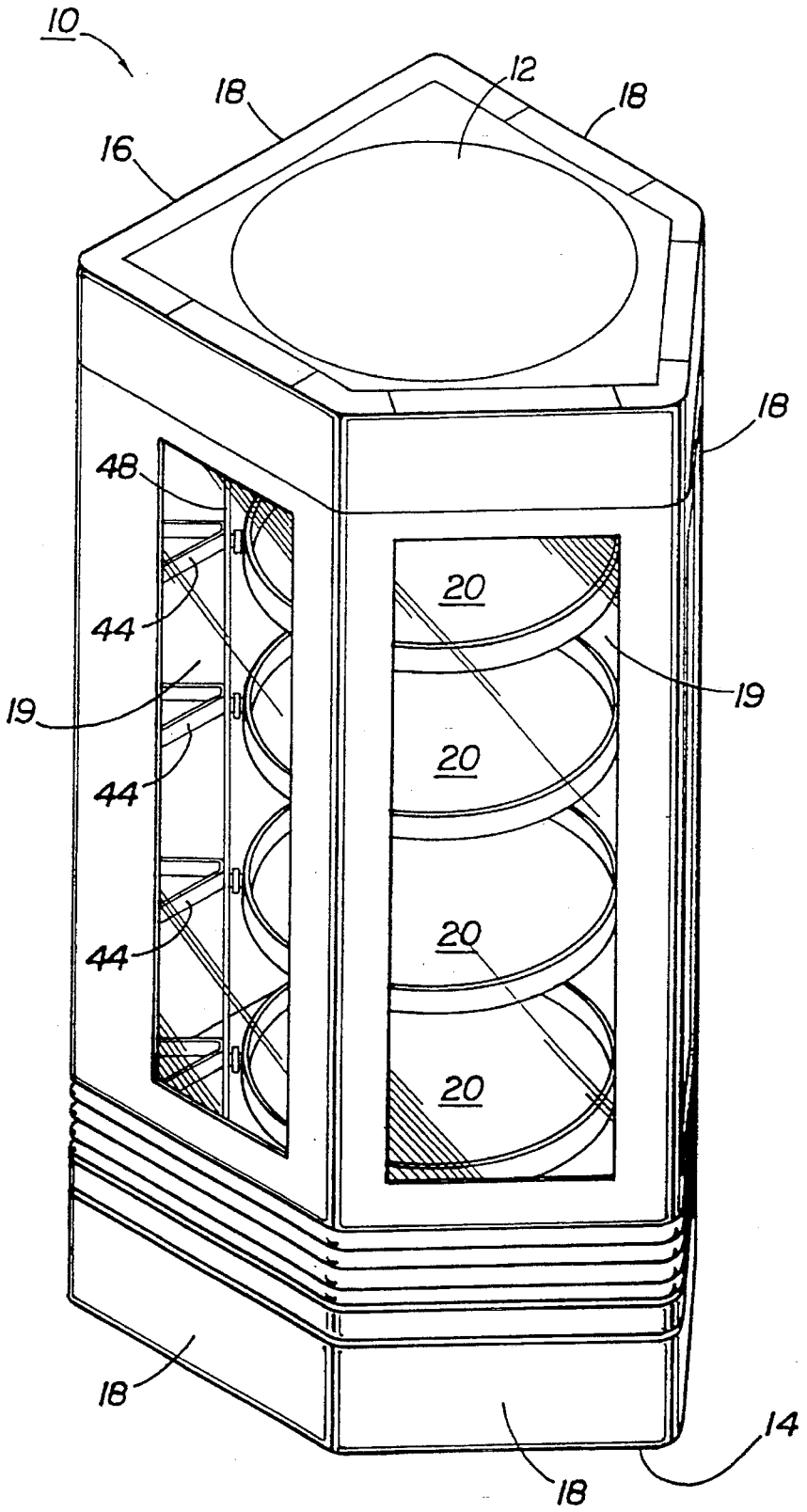
FIG. 1 is a top perspective view of an enclosure housing a plurality of shelves.

The invention is now described in detail. Referring to the drawings, like numbers indicate like parts throughout the views.

Referring to FIG. 1, a preferred embodiment of the present invention comprises an housing 10, defining an enclosure having a top 12, a bottom 14, a back 16 and a plurality of side walls 18. The housing 10 houses a plurality of shelves 20 upon which objects (such as soft drinks or other beverages) may be displayed. Typically, the sidewalls 18 defining the front half of the enclosure have transparent portions 19 so that objects on the shelves 20 can be seen from outside the housing 10.

Figure 2:
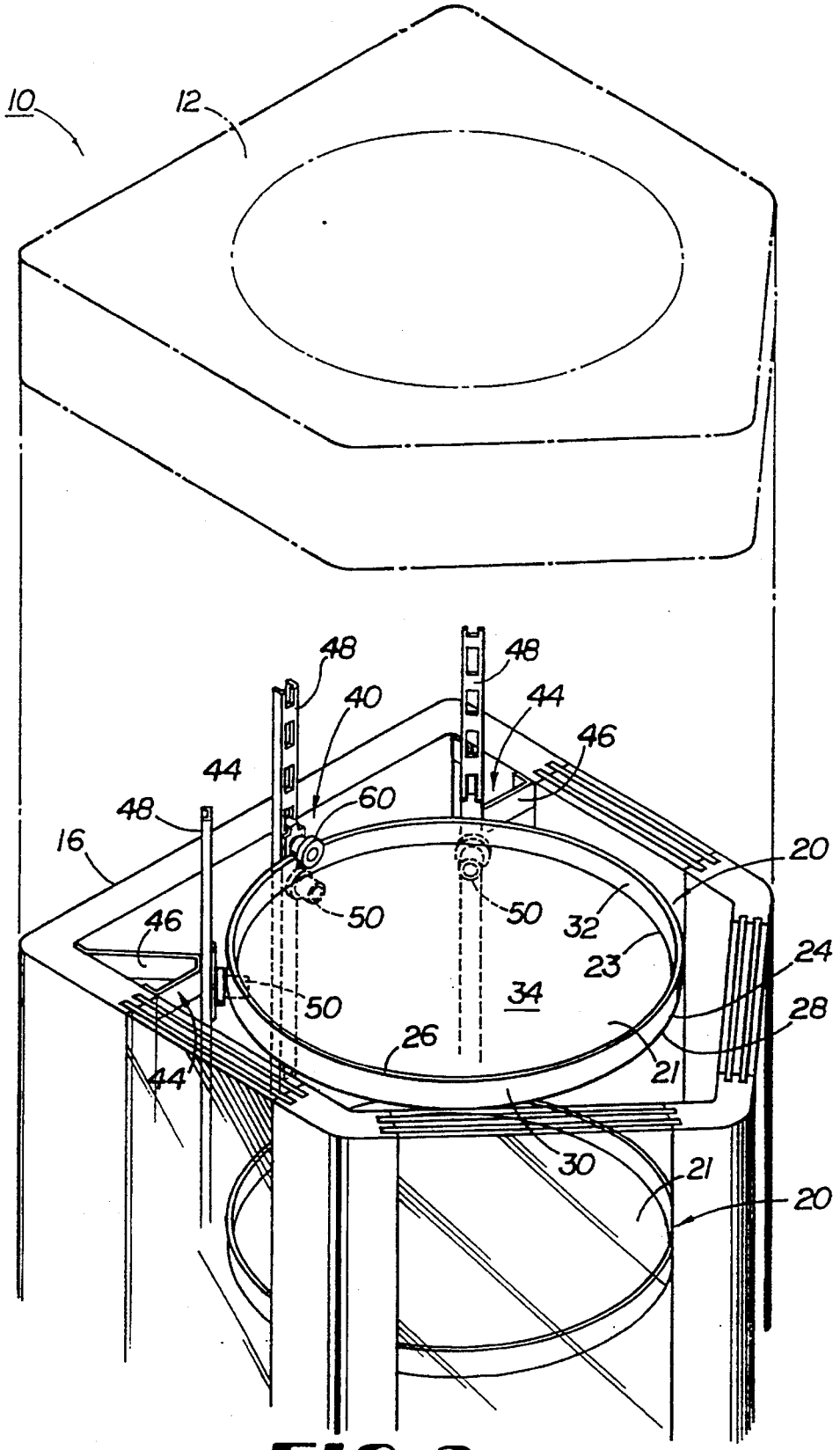
FIG. 2 is an exploded top perspective view of an enclosure, showing a shelf and its supporting means.

As shown in FIG. 2, each shelf 20 comprises a disk 21 having a horizontal top surface 34, a bottom surface 28, an outer edge 23 and a rim 24 extending upward from the outer edge 23. The rim 24 has a upper surface 26, an inner surface 32 and an outer surface 30. A means 40 for supporting the disk 21, disposed in the back half 16 of the housing 10, engages the rim 24 so that the disk 21 can rotate freely about its centrally located vertical axis.

Figure 3:
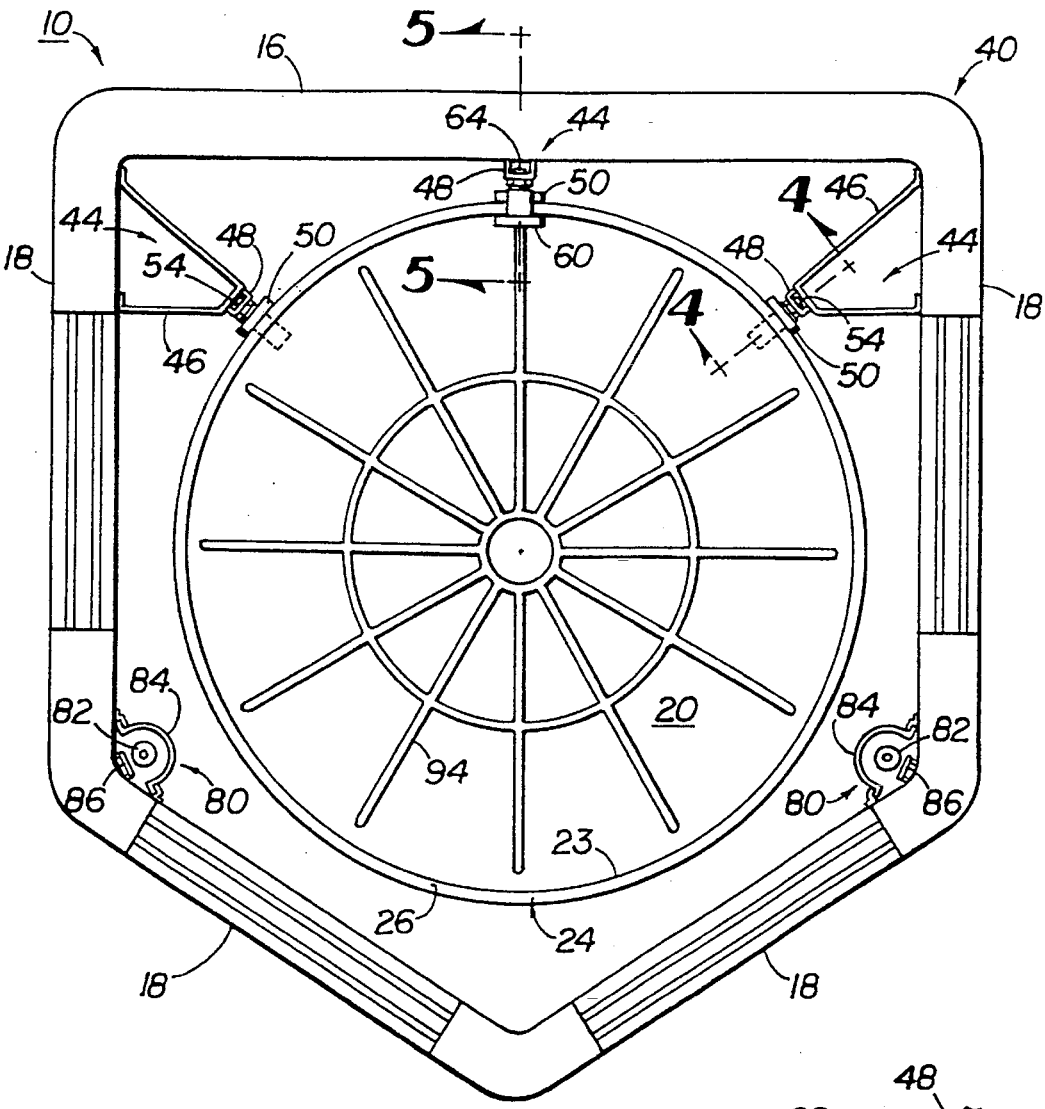
FIG. 3 is top view of a shelf supported within an enclosure.

Referring to FIG. 3, the supporting means 40 comprises at least three vertical members 44, at least three bottom-support rollers 50 and at least one top-support roller 60. The vertical members 44 may be attached to the sidewalls 18 of the housing 10 and have a vertical fastening surface 48 to which the bottom support rollers 50 and the top support rollers 60 are attached. The fastening surfaces 48 may comprise elongated strips of metal having a plurality of spaced-apart slots 47 along its length capable of receiving therein support pegs 54.

Figure 4:
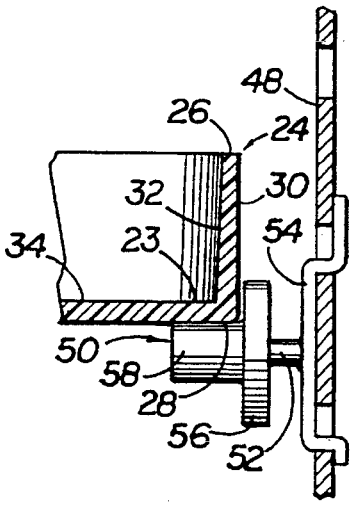
FIG. 4 is side view of a bottom-support roller supporting the bottom surface of a disk.

Referring to FIG. 4, the bottom edge 28 of the rim 24 rests on the bottom-support rollers 50 which is rotably mounted on an axle 52 that is affixed to a mounting peg 54 which, in turn, engages the fastening surface 48. The bottom-support roller 50 has a flanged portion 56 which prevents outward radial movement of the shelf 20 by contacting the rim's outward surface 30 when the shelf 20 is moved horizontally.

Figure 5:
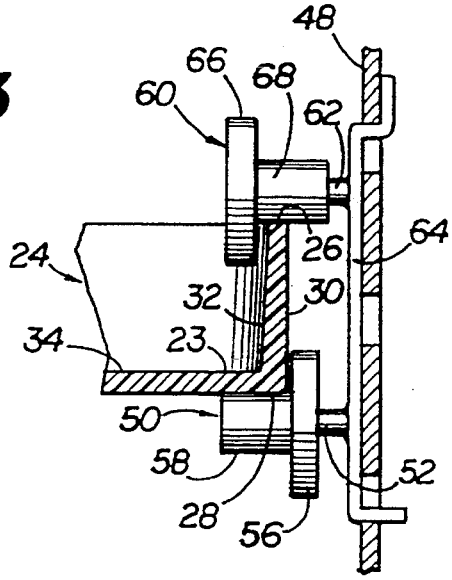
FIG. 5 is side view of a bottom-support roller supporting the bottom surface of a disk and a top-support roller supporting the top surface of a disk.

At least one top-support roller 60 is required keep the shelf 20 from tipping forward. As shown in FIG. 5, and as with the rollers 50, a top-support roller 60 is rotably mounted on an axle 62 that is affixed to a mounting peg 64 which, in turn, engages the fastening surface 48. The top-support roller 60 can share a common mounting peg 64 with a bottom-support roller 50. The top-support roller 60 contacts the top edge 26 of the rim 24 to prevent tipping of the shelf 20 and has a flanged inward portion 66 which prevents the forward horizontal movement of the shelf 20 by contacting the rim's inward surface 32. In one preferred embodiment, the shelf 20 is supported by at least three bottom-support rollers 50 and at least one top-support roller 60. At least two bottom-support rollers 50 must be horizontal with, and on opposite sides of, the top-support roller 60 to ensure stability of the shelf 20. Of course, more than three bottom-support rollers 50 may be used to improve stability.

Figure 6:
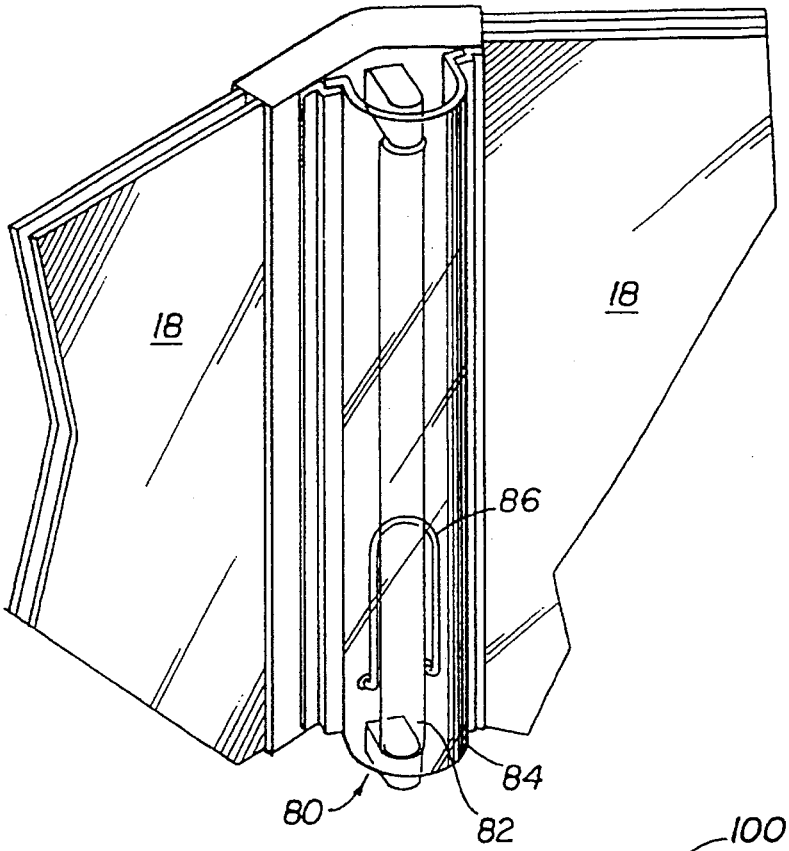
FIG. 6 is side view of a lamp assembly.

The cantilevered supporting of the shelves 20 allows lamp assemblies 80 to be placed in the front of the housing 10 without the light from the lamps 80 being obstructed by shelf supports. As shown in FIG. 6, the lamp assembly 80 used for refrigerated enclosures may comprise a florescent bulb 82 enclosed by a transparent sheath 84. The sheath 84 insulates the bulb 82 from the refrigerated air in the enclosure. A heating element 86 may be placed within the sheath 84 to maintain the temperature of the air surrounding the lamp at a temperature higher than the ambient temperature in the enclosure. Typically the temperature range inside the sheath 84 should be from 50° F. to 60° F.—the optimal operating range of a florescent bulb.

Figure 7:
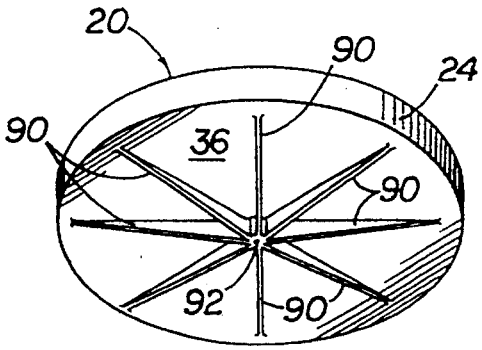
FIG. 7 is a bottom perspective view of a disk with rigidity-adding struts attached to the bottom surface of the disk.

As shown in FIG. 7, means for strengthening the shelf 20 may include a plurality of spaced apart struts 90 on the bottom surface 36 of the shelf 20 extending radially outward from the center 92. An alternative means for increasing rigidity, as shown in FIG. 5, comprises a pattern of indentations 94 formed on the surface of the shelf 20.

Figure 8:
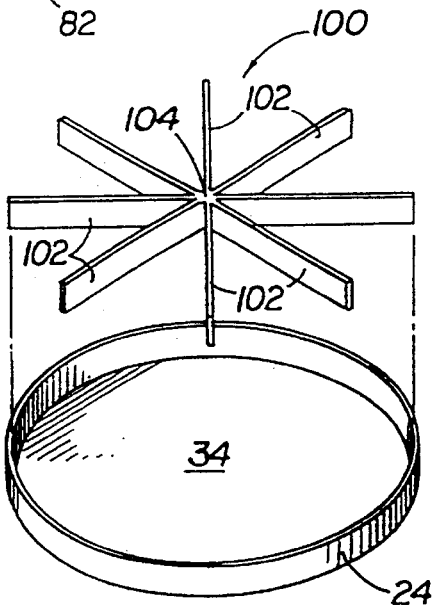
FIG. 8 is a top exploded view of a disk and a divider which rests on the disk.

As shown in FIG. 8, a divider means 100, resting on the top surface 34 of the shelf, may be added to separate products being displayed. The divider means 100 may comprise a plurality of partitions 102 resting on the top surface 34 of the shelf extending radially outward from a central point 104 toward the rim 24.

Figure 9:
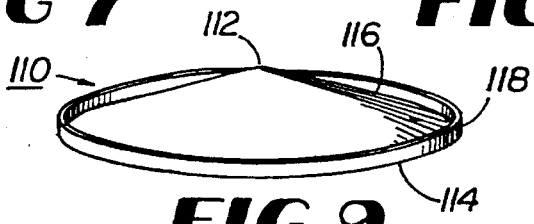
FIG. 9 is a top perspective view of a conical gravity-feed shelf.

In an alternative embodiment, as shown in FIG. 9, a substantially conical shelf 110 may be used. The conical shelf 110 has a center 112 and an outer periphery 114. The top surface 116 of the shelf 110 is conical, sloping downward from the center 112 to the outer periphery 114, so that objects placed on the shelf 110 are gravity-fed toward the outer periphery 114 until they engage the rim 118.

The above embodiments are given as illustrative examples and are not intended to impose any limitations on the invention. It will be readily appreciated that many deviations may be made from the specific embodiments disclosed in this specification without departing from the invention. Accordingly it is intended to cover all such modifications as within the scope of this invention.

What is claimed is:

1. A display, comprising:

a. a housing having a plurality of upstanding side walls defining therein an enclosure, the enclosure having a front half and a back half;

b. a circular rotatable shelf having a vertical axis, the shelf disposed within the enclosure, a portion of the shelf being disposed in the back half of the enclosure, with the vertical axis of the shelf in alignment with a plane defining an interface between the front half and the back half of the enclosure; and c. means disposed within the enclosure, only in the back half of the enclosure, for supporting the shelf for rotation about the vertical axis of the shelf, wherein the supporting means comprises:

i. at least three vertical members disposed within the back half of the enclosure and secured to the side walls of the back half of the housing;

ii. a plurality of mounting pegs, each detachably secured to a vertical member;

iii. at least three bottom axles, each being affixed to one of the mounting pegs and laterally extending into the enclosure;

iv. at least three horizontally spaced apart co-planar bottom support rollers disposed in the back half of the enclosure and rotatable about a horizontal axis, each bottom support roller having a first cylindrical member coaxial with and rotably mounted on an axle, the first cylindrical member having a rear edge adjacent the side wall terminating in a flanged portion;

v. a top axle affixed to one of the mounting pegs and laterally extending into the enclosure; and vi. a top support roller disposed in the back half of the enclosure above the bottom support rollers and laterally disposed between at least two of the bottom support rollers, the top support roller being rotatable about a horizontal axis and having a second cylindrical member rotably mounted on the top axle, the second cylindrical member having a front edge terminating in a flanged portion.

2. The display of claim 1 wherein the shelf comprises:

a. a disk having a top surface, a bottom surface and an outer edge; and b. a rim upwardly extending about the outer edge and having an upper surface, an inner surface and an outer surface.

3. The display of claim 1 wherein the support means comprises:

a. at least three bottom axles secured to the side walls of the back half of the housing and laterally extending into the enclosure;

b. at least three horizontally spaced apart co-planar bottom support rollers disposed in the back half of the enclosure and rotatable about a horizontal axis, each bottom support roller having a first cylindrical member coaxial with and rotably mounted on an axle, the first cylindrical member having a rear edge adjacent the side wall terminating in a flanged portion; and c. a top support roller disposed in the back half of the enclosure above the bottom support rollers and laterally disposed between at least two of the bottom support rollers, the top support roller being rotatable about a horizontal axis, a top axle secured to a sidewall and laterally extending into the enclosure, the top support roller having a second cylindrical member rotably mounted on the top axle, the second cylindrical member having a front edge terminating in a flanged portion.

4. The display of claim 1 further comprising a lamp disposed vertically in the front half of the enclosure and positioned to provide illumination of the shelf unobstructed by the supporting means.

5. The display of claim 4 wherein the lamp is a fluorescent lamp, the enclosure is refrigerated, and the lamp is surrounded by a transparent sheath insulating the lamp from refrigerated air in the enclosure.

6. The display of claim 5 further comprising a heating element disposed within the sheath to maintain the temperature of air surrounding the lamp at a temperature higher than the refrigerated air in the enclosure.

7. The display of claim 6 wherein the heating element maintains the temperature of the air surrounding the lamp between 50° F. and 60° F.

8. The display of claim 1 wherein at least one of the side walls at the front portion of the enclosure is transparent so that objects on the shelf can be seen from outside the enclosure.

9. The display of claim 1 further comprising means for reinforcing the shelf.

10. The display of claim 9 wherein the means for reinforcing comprises a plurality of spaced-apart struts on the bottom surface of the disk extending radially outwardly from the center thereof.

11. The display of claim 9 wherein the means for reinforcing comprises a plurality of spaced-apart linear depressions formed on the disk extending radially outwardly from the center thereof.

12. The display of claim 1 comprising a plurality of shelves each supported by a corresponding supporting means, the plurality of shelves disposed in spaced-apart vertical relationship with one another within the enclosure.

13. A display, comprising:

a. a housing having a plurality of upstanding side walls defining therein an enclosure, the enclosure having a front half and a back half;

b. a circular rotatable shelf having a vertical axis, the shelf disposed within the enclosure, a portion of the shelf being disposed in the back half of the enclosure, with the vertical axis of the shelf in alignment with a plane defining an interface between the front half and the back half of the enclosure; and c. means disposed within the enclosure, only in the back half of the enclosure, for supporting the shelf for rotation about the vertical axis of the shelf, wherein the supporting means comprises:

i. at least three bottom axles secured to the side walls of the back half of the housing and laterally extending into the enclosure;

ii. at least three horizontally spaced apart co-planar bottom support rollers disposed in the back half of the enclosure and rotatable about a horizontal axis, each bottom support roller having a first cylindrical member coaxial with and rotably mounted on an axle, the cylindrical member having a rear edge adjacent the side wall terminating in a flanged portion; and iii. a top support roller disposed in the back half of the enclosure above the bottom support rollers and laterally disposed between at least two of the bottom support rollers, the top support roller being rotatable about a horizontal axis, a top axle secured to a sidewall and laterally extending into the enclosure, the top support roller having a second cylindrical member rotably mounted on the top axle, the second cylindrical member having a front edge terminating in a flanged portion, wherein the cylindrical member of the bottom support rollers engages the bottom surface of the disk adjacent the outer edge thereof to prevent the portion of the shelf in the back half of the enclosure from tipping downward while allowing the shelf to rotate about its axis, the flanged portion of the bottom support rollers being disposed adjacent the outer surface of the rim to prevent the disk from moving laterally outward from the front half of the enclosure.

14. A display, comprising:

a. a housing having a plurality of upstanding side walls defining therein an enclosure, the enclosure having a front half and a back half;

b. a circular rotatable shelf having a vertical axis, the shelf disposed within the enclosure, a portion of the shelf being disposed in the back half of the enclosure, with the vertical axis of the shelf in alignment with a plane defining an interface between the front half and the back half of the enclosure; and c. means disposed within the enclosure, only in the back half of the enclosure, for supporting the shelf for rotation about the vertical axis of the shelf wherein the supporting means comprises:

i. at least three bottom axles secured to the side walls of the back half of the housing and laterally extending into the enclosure;

ii. at least three horizontally spaced apart co-planar bottom support rollers disposed in the back half of the enclosure and rotatable about a horizontal axis, each bottom support roller having a first cylindrical member coaxial with and rotably mounted on an axle, the first cylindrical member having a rear edge adjacent the side wall terminating in a flanged portion; and iii. a top support roller disposed in the back half of the enclosure above the bottom support rollers and laterally disposed between at least two of the bottom support rollers, the top support roller being rotatable about a horizontal axis, a top axle secured to a sidewall and laterally extending into the enclosure, the top support roller having a second cylindrical member rotably mounted on the top axle, the second cylindrical member having a front edge terminating in a flanged portion, wherein the cylindrical member of the top support roller engages the upper surface of the rim, to prevent the portion of the shelf in the back half of the enclosure from tipping upward while allowing the shelf to rotate about its axis, with the flanged portion of the top support roller being adjacent the inner surface of the rim to prevent the disk from moving laterally inward toward the front half of the enclosure.

15. A refrigerated display, comprising:

a. a housing having a plurality of upstanding side walls defining therein an enclosure, the enclosure having a front half and a back half, with at least one of the side walls at the front half of the enclosure transparent so that objects on the shelf can be seen from outside the enclosure;

b. a circular rotatable shelf having a vertical axis, the shelf disposed within the enclosure with the vertical axis of the shelf in alignment with the plane defining the interface between the front half and the back half of the enclosure, the shelf comprising a disk having a top surface, a bottom surface and an outer edge and a rim upwardly extending about the outer edge and having an upper surface, an inner surface and an outer surface;

c. means, disposed within only the back half of the enclosure, for supporting the shelf for rotation about the vertical axis of the shelf, comprising at least three vertical members disposed within the back half of the enclosure and secured to the housing, a plurality of mounting pegs, each detachably secured to a vertical member, at least one bottom axle affixed to each mounting peg a top axle affixed to a mounting peg and a roller rotably attached to each axle; and d. a lamp disposed vertically in the front half of the enclosure and positioned to provide illumination of the shelf unobstructed by the supporting means.

16. The display of claim 15 wherein the support means further comprises:

a. at least three bottom axles secured to the side walls of the back half of the housing and laterally extending into the enclosure;

b. at least three horizontally spaced apart co-planar bottom support rollers disposed in the back half of the enclosure, each bottom support roller having a cylindrical member coaxial with and rotably mounted on an axle, the cylindrical member having a rear edge, the rear edge of the cylindrical member adjacent the side wall terminating in a flanged portion, the cylindrical member of the bottom support rollers engaging the bottom surface of the disk adjacent the outer edge thereof to prevent a portion of the shelf in the back half of the enclosure from tipping downward while allowing the shelf to rotate about its axis, the flanged portion of the bottom support rollers being disposed adjacent the outer surface of the rim to prevent the disk from moving laterally outward from the front half of the enclosure; and c. a top support roller disposed in the back half of the enclosure above the bottom support rollers and laterally disposed between at least two of the bottom support rollers, a top axle secured to a sidewall and laterally extending into the enclosure, the top support roller having a cylindrical member rotably mounted on the top axle, the cylindrical member having a front edge, the front edge of the cylindrical member terminating in a flanged portion, the cylindrical member of the top support roller engaging the upper surface of the rim, to prevent a portion of the shelf in the back half of the enclosure from tipping upward while allowing the shelf to rotate about its axis, with the flanged portion of the top support roller being adjacent the inner surface of the rim to prevent the disk from moving laterally inward toward the front half of the enclosure.

17. The display of claim 15 wherein the lamp is a fluorescent lamp and the enclosure further comprises means for maintaining the temperature of the air surrounding the lamp at a temperature higher than the temperature of the air in the enclosure.

18. The display of claim 17 wherein the means for maintaining temperature comprises:

a. a transparent sheath surrounding the lamp and insulating the lamp from refrigerated air in the enclosure; and b. a heating element disposed within the sheath to maintain the temperature of air surrounding the lamp between 50° F. and 60° F.

* * * * *